US005527044A

United States Patent [19]

Lee et al.

[11] Patent Number: 5,527,044

[45] Date of Patent: Jun. 18, 1996

[54] ARCADE TYPE OF TOY

[75] Inventors: James S. W. Lee, Long Island, N.Y.; Chiu K. Kwan, Kowloon, Hong Kong

[73] Assignee: C. J. Associates, Ltd., Kowloon, Hong Kong

[21] Appl. No.: 195,328

[22] Filed: Feb. 14, 1994

[51] Int. Cl.[6] ..... A63F 9/00

[52] U.S. Cl. ..... 273/448

[58] Field of Search ..... 273/447, 448, 273/442; 221/210; 446/426, 424, 427, 228, 229

[56] References Cited

U.S. PATENT DOCUMENTS

| | | | |
|---|---|---|---|
| 1,630,195 | 5/1927 | Margolith | 221/210 X |
| 1,860,509 | 5/1932 | Maass | 221/210 X |
| 1,882,563 | 10/1932 | Bartlett | 221/210 X |
| 1,968,226 | 7/1934 | Simpkins | 221/210 |
| 2,007,325 | 7/1935 | Carney | 221/210 |
| 3,572,703 | 3/1971 | Greene | 273/448 |
| 4,718,667 | 1/1988 | Shoemaker, Jr. | 273/448 |
| 4,778,176 | 10/1988 | Shoemaker, Jr. | 273/448 |

FOREIGN PATENT DOCUMENTS

| | | | |
|---|---|---|---|
| 4084985 | 3/1992 | Japan | 273/447 |
| 429694 | 6/1935 | United Kingdom | 221/210 |
| 2188852 | 10/1987 | United Kingdom | 273/442 |

*Primary Examiner*—Paul E. Shapiro

*Attorney, Agent, or Firm*—Laff, Whitesel, Conte & Saret, Ltd.

[57] ABSTRACT

A toy simulates an arcade game. A box has a transparent side panel and contains game device that may be manipulated from a control panel at a front of a box. Here the game device is a toy boat or submarine that slides horizontally and deploys a claw to pick up objects on the bottom panel. The boat and claw have separate reversible motors which turn in one direction or the other depending upon the polarity of the applied voltage. To play the game, a user looks at the game pieces while he manipulates the controls at the front of the box in order to pick up an object and drop it through a chute.

8 Claims, 2 Drawing Sheets

ARCADE TYPE OF TOY

This invention relates to toys and more particularly to toys simulating arcade types of games, especially toy for use in a family environment.

Generally, arcade games are fairly large, heavy, and expensive machines which permit a person to manipulate controls in order to accumulate a score, compete with other players, and the like. Examples of such arcade games are pinball machines, pachinko, computerized simulations of war games or sports events, for example.

These machines are found in places such as public rooms, restaurants, or the like, primarily because they are too expensive and occupy too much space for the average home. Nevertheless, people would like to have them in a convenient environment, such as the home, for family entertainment. This is especially true when children are involved. They want to play simulations of games that they have seen adults play in public rooms, on TV, and in the movies. Their parents want to know both where they are and that they are out of harm's and temptation's way.

To fill this need, the arcade game machine simulating toy should sell at a very low cost, should be light enough to carry easily, and should not occupy too much room. It should be easy enough to play for a child to become an accomplished player. Still, it should be challenging enough for a youth, parents, or adults to find of interest.

Accordingly, an object of the invention is to provide toys and games of the described type with new and novel forms of play. In this connection, an object is to provide an arcade game simulating toy which may be made in a great variety of different ways. In this connection, an object is to make both simple games which a child can play and more complex games requiring a higher level of hand and eye coordination.

In keeping with an aspect of this invention, these and other objects are accomplished by providing a box which is visually open to inspection on one side. A transparent panel covers the open side of the box. The background behind the transparent panel may include any graphics or objects appropriate to the game. Controls on the front of the box enable the player to manipulate objects behind the transparent panel. Thus, for example, the arrangement might be a toy or machine which may drop a claw or dredge in order to scoop up a treasure. Then the claw holding the treasure may be transported to a position over a chute so that the treasure may be delivered to the child.

A preferred embodiment of the invention is shown in the attached drawing in which.

Figure 1:
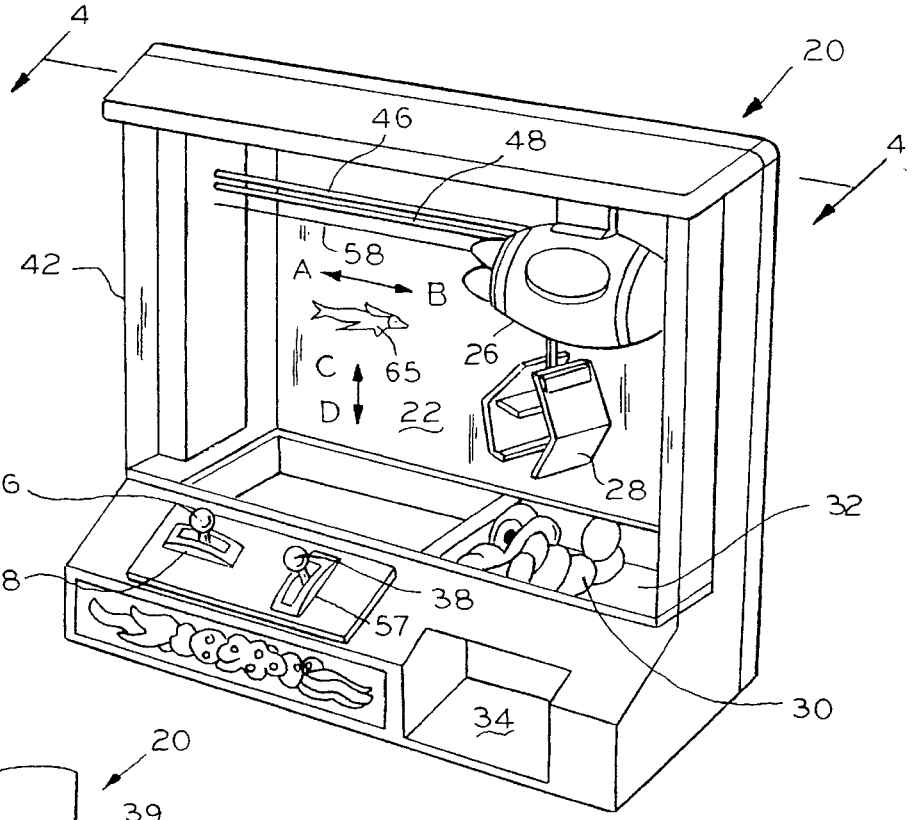
FIG. 1 is a perspective view showing an example of an inventive game featuring a claw for picking up an object.

In FIG. 1, a box 20 has an open front which reveals inside surfaces of the box. A transparent panel 22 covers the open side of the box. As here shown, there appears to be a submarine 26 which may travel back and forth in directions A, B. Suspended beneath the submarine 26 is a claw 28 which may move up or down in directions C, D. On the "ocean floor", there is a sea creature 30 or other prizes to be recovered.

The object of the game is to manipulate the claw 28 so that it will pick up the sea creature 30, or other prize, and carry it over a chute 32 where it is dropped. The chute 32 carries the sea creature, or other prize, to a delivery area 34 where the player may retrieve it. As here shown, the sea creature 30 has been released from the claw 28 and is dropping into and falling through the chute.

The play is controlled by manipulation of control means in the form of two control levers 36, 38 mounted on the front of box 20 and below the viewing area of the transparent panel 22. Lever 36 moves left and right to cause the submarine 26 to move left and right (directions A, B). The lever 38 moves forward and backward to cause the claw 28 to go up and down (directions C, D). At an appropriate place on the box 20, probably the back, or perhaps the top, there is a door 39 (FIG. 2) which the player may open to return the sea creature 30 to the playing area. Alternatively, any suitable toys or other "prizes" may be inserted through the door 39 and into the playing area. The inserted toys or prizes might be prizes for a birthday party, for example. Batteries may be installed or removed by opening a door 42. The levers 36, 38 (FIG. 1) close circuits to apply a voltage from these batteries to small d.c. motors which move the submarine 26 and claw 28. The polarity of the applied battery voltage is determined by whether lever 36 moves left or right and by whether lever 38 moves forward or backward.

Figure 4:
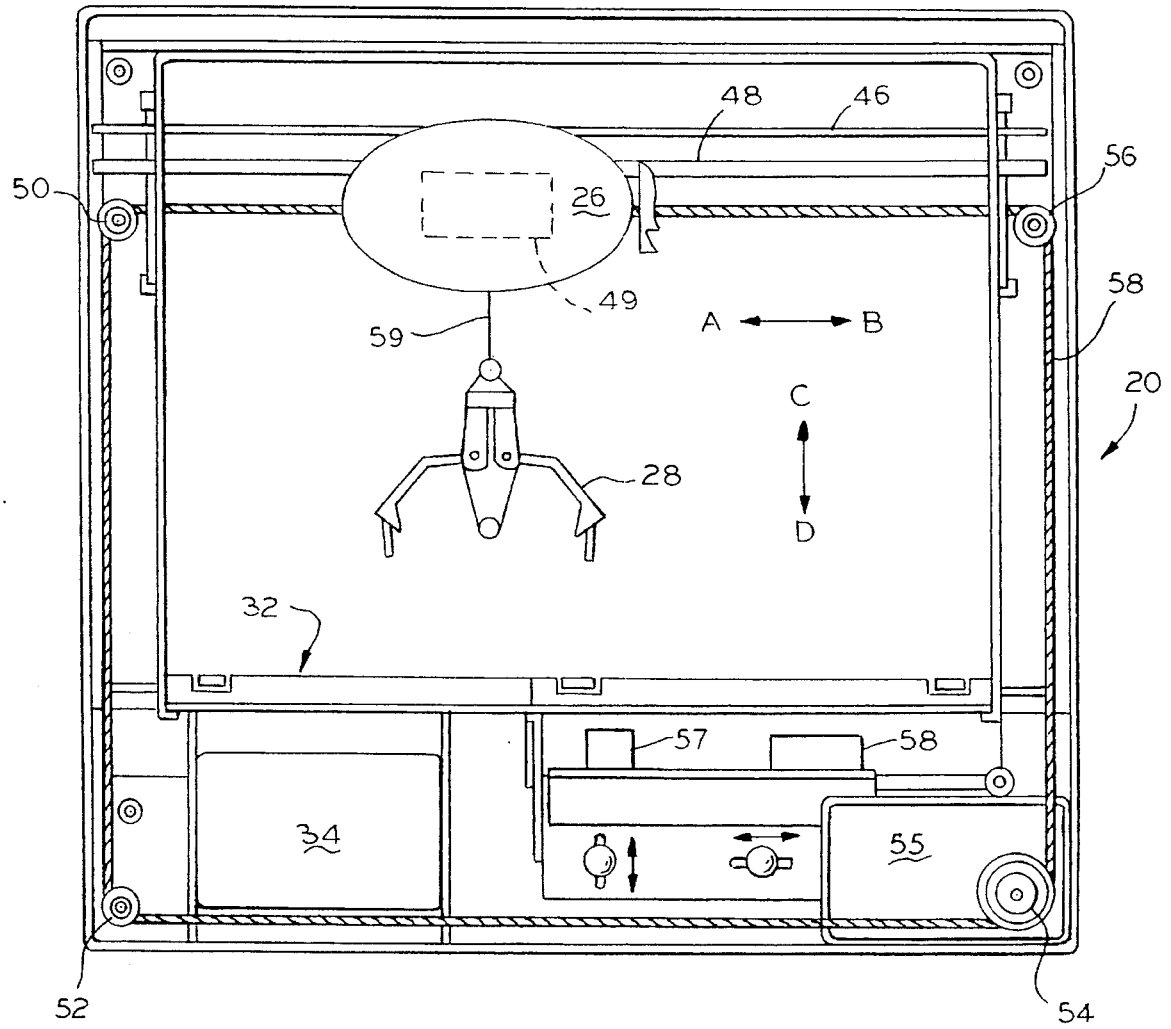
FIG. 4 is a schematic plan view, taken along line 4—4 of FIG. 1, showing of an exemplary construction of the game of FIG. 1.

FIG. 4 shows an elevation view looking from the back of box 20 through the transparent panel 22. The chute 32 receives the object picked up by the claw 28 and guides the falling object through an opening 34 on the front of the box 20, from which it may be recovered.

The submarine 26 is slidingly carried on two metal rails 46, 48 which also act as electrical conductors for carrying battery current to a motor 49 inside the submarine. Four pulley wheels 50, 52, 54, 56 are located at the four corners of the transparent panel 22 on the front of the box 20. These pulley wheels are in positions which do not appear in the format viewed by the player. A nylon cord 58 is trained over the four pulley wheels 50–56. The opposite ends of the cord are fastened to the submarine 26. Therefore, if cord 58 is pulled in one direction, the submarine 26 travels in direction A. If the cord is pulled in an opposite direction, the submarine 26 travels in direction B.

A DC battery driven motor and gear train 55 are located inside the box 20. The plastic housings 57, 58 for supporting, guiding, and directing the control levers or handles 36, 38 can be seen near motor 55. Lever 36 controls motor 55; lever 38 controls motor 49. When either of the levers 36, 38 is moved in one direction, d.c. motor 55 or 49 is driven in one direction. When either lever is moved in an opposite direction, the individually associated one of the d.c. motors 55 or 49 is driven in an opposite direction.

Therefore, if control lever 36 is moved to the left, the motor 55 is driven in a direction which turns pulley 54 to causes the nylon cord 58 to pull the submarine 26 to the left. If the control lever 36 is moved to the right, motor 55 turns in an opposite direction and drives pulley 54 to pull the submarine 26 to the right. Background graphics 65 (FIG. 1) may be provided on the back of the box 20 so that the submarine 26 will appear to be moving against an underwater background.

A second d.c. battery driven motor 49 is concealed inside the submarine 26. This motor 49 is controlled by the lever 38 and is energized via the rails 46, 48. When lever 38 is pulled forward, the motor in submarine 26 is driven in one direction to lower claw 28. The claw automatically closes when a chain 59 which connects claw 28 to motor 49 is reeled in. When the control lever 38 is pushed back, the motor is driven in an opposite direction to pay out the chain and the claw opens.

More particularly, the claw 28 is formed of two shovel parts 66, 68 that are articulated at an axis 70. Each shovel parts 66, 68 also has an integral articulating arm 72, 74 pivotally connected together at 70. A pair of links 76, 78 are pivotally connected between a common part 80 and the two shovel parts. The common part 80 is in turn connected to two chains 59. The chains are paid out and reeled in depending upon the direction in which motor 49 turns. One chain is connected to the upper and common part 80. The other chain pass through center a hole 18 in the common part 80 and is connected to the pivot point 70.

When the player moves the control lever 36 in the direction D the first end of the chain connected to pivot point 70 is lowered while the chain 59 connected to common part 80 is held in tension. The weight carried at the axis 70, and by the effect of gravity on each of the shovel parts 66, 68, opens the claw. When the player moves the control lever 36 in the direction C, the chain 59 connected to pivot point 70 is in tension so that the shovel parts 66, 68 close. Therefore, by moving the two levers 36, 38, the claw 28 may be moved to any spot within the view presented through transparent panel 22. When the claw is correctly positioned, it will pick up the object 30 (FIG. 2) that was placed in the box. By further manipulation of control levers 36, 38, the object is carried to an opening 32 where it is dropped into a chute for delivery to the player at opening 34 (FIG. 1).

Figure 2:
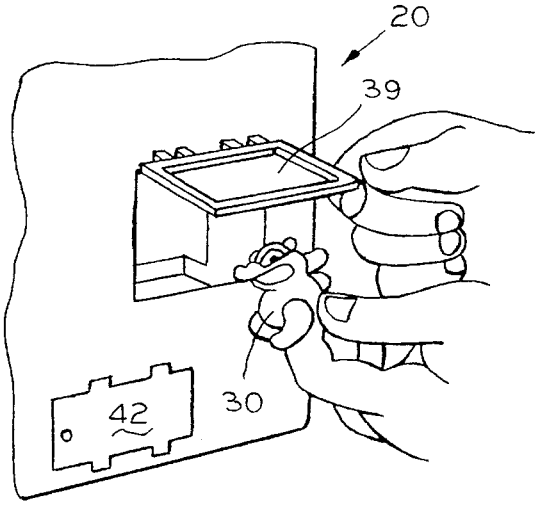
FIG. 2 is a perspective view which shows a player inserting one example of an object which is to be picked up into a box forming a toy arcade game.
Figure 3:
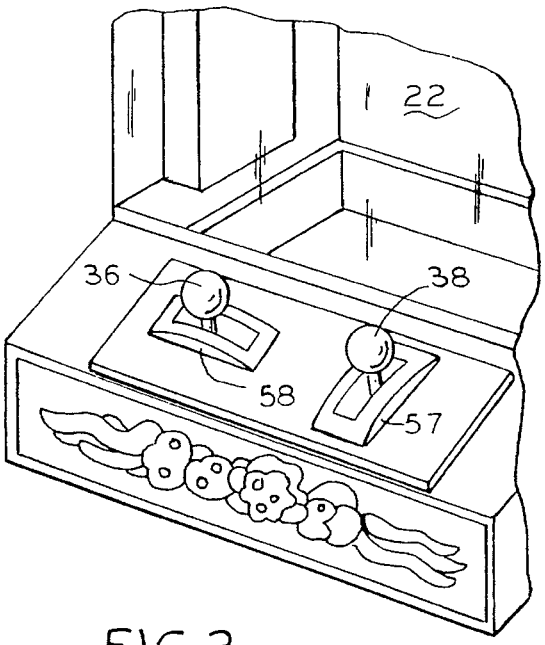
FIG. 3 is a perspective view which shows the control panel of the toy of FIG. 1.

The user may be supplied with a number of alternative objects to be dropped into the door 39 (FIG. 2). One object, which could be of interest to a child, can have many surfaces formed at angles so that the claw 28 can pick it up very easily. Another object, which would be of interest to an adult, can have relatively smooth contours so that it can only be picked up when the claw engages it in one manner. Between these two extremes, other objects could be on a graduated scale so that as the players skill level increases, he can graduate to an object which is more difficult to pick up.

Those who are skilled in the art will readily perceive how to modify the invention. Therefore, the appended claims are to be construed to cover all equivalent structures which fall within the true scope and spirit of the invention.

The invention claimed is:

1. A toy simulation of an arcade game, said toy comprising a box open to view on at least one side with a transparent panel covering the open side, a claw in said box, means for mounting said claw for horizontal and vertical motion, controls on said box for manipulating said claw to pick up objects in said box, two separate reversible electric motors in said box, an electrical circuit extending from said controls to said two separate electric motors, means operated by one of said motors for moving said claw in said horizontal direction, means operated by the other of said motors for moving said claw in said vertical direction, means for delivering said picked up object to a player who is manipulating said controls, and a pair of rails on which an object carrying said claw may slide, said rails constituting conductors for energizing said other motor.

2. The toy of claim 1 further comprising a battery, and wherein each of said motors operates in either of two directions depending upon the polarity of voltage applied thereto, said controls comprising means for selectively applying energy from said battery to individual ones of said motors with a selected polarity.

3. A toy comprising a box which is at least partly closed on at least three sides and visually open on at least one side, a transparent panel over said open side and forming a side of said box, at least two rails along which a first object can slide within said box, a second object which is deployed from said first object, a first motor for causing said first object to slide in either direction over said rails, a second motor in said first object for deploying or retrieving said second object, each of said motors being a reversible motor which changes its direction of rotation responsive to a change of the polarity of voltage applied thereto, said two rails forming conductors for conveying electricity to said second motor, manipulating means for simultaneously sliding said first object and deploying said second object to a particular location, said manipulating means controlling the polarity of signals sent to said first motor for sliding said first object and of signals sent over said two rails for deploying and retrieving said second object.

4. The toy of claim 3 wherein said manipulation means is a pair of switches for controlling the polarity of signals applied to said two motors rails.

5. The toy of claim 3 and a plurality of pulley wheels for supporting a closed cord loop, said cord loop being formed of an elongated member with its opposite ends attached to said first object so that said first object slides in one direction when said loop is moved in a clockwise direction and said first object slides in an opposite direction when said loop is moved in a counter clockwise direction, said first reversible motor means being mounted in said box and coupled to cause said loop to move in either said clockwise or said counter clockwise directions.

6. The toy of claim 5 wherein said first object is a toy boat and said second object is a claw deployed from said toy boat, said first motor is mounted in said box for controlling the motion of said toy boat, said second motor is in said boat and controls said deployment of said claw.

7. The toy of claim 6 and chute means for delivering objects picked up by said claw to an outside opening in said toy for the player to retrieve.

8. The toy of claim 7 and means for reintroducing said picked up object into said box, there being a plurality of said objects to be picked-up, said objects to be picked up having a range of contours in order to provide a range of difficulty when said claw picks up said object.

* * * * *